US008991613B2

(12) United States Patent
Mohanka

(10) Patent No.: US 8,991,613 B2
(45) Date of Patent: Mar. 31, 2015

(54) SCREEN PANEL WITH IMPROVED APERTURES

(75) Inventor: Madan Mohan Mohanka, Kolkata (IN)

(73) Assignee: TEGA Industries Limited, Kolkata, West Bengal (IN)

( * ) Notice: Subject to any disclaimer, the term of this patent is extended or adjusted under 35 U.S.C. 154(b) by 127 days.

(21) Appl. No.: 13/820,432

(22) PCT Filed: Mar. 11, 2011

(86) PCT No.: PCT/IN2011/000167

§ 371 (c)(1),
(2), (4) Date: May 5, 2013

(87) PCT Pub. No.: WO2012/029072

PCT Pub. Date: Mar. 8, 2012

(65) Prior Publication Data

US 2013/0213863 A1 Aug. 22, 2013

(30) Foreign Application Priority Data

Sep. 1, 2010 (IN) ..... 981/KOL/2010

(51) Int. Cl.
*B07B 1/00* (2006.01)
*B07B 1/46* (2006.01)

(52) U.S. Cl.
CPC ..... *B07B 1/4609* (2013.01); *B07B 1/4645* (2013.01)
USPC ..... 209/363; 209/392; 209/393; 209/397; 209/401

(58) Field of Classification Search
USPC ..... 209/401, 412
See application file for complete search history.

(56) References Cited

U.S. PATENT DOCUMENTS

| | | | | |
|---|---|---|---|---|
| 4,120,785 | A | 10/1978 | Kanamori et al. | |
| 4,892,767 | A * | 1/1990 | Freissle | 428/52 |
| 2009/0071879 | A1 * | 3/2009 | Helmy | 209/412 |

FOREIGN PATENT DOCUMENTS

| | | | | |
|---|---|---|---|---|
| AU | 2835477 A | 3/1979 | | |
| DE | 1251635 B | 10/1967 | | |
| GB | 2143751 A | 2/1985 | | |
| GB | 2143751 A * | 2/1985 | | B07B 1/46 |

OTHER PUBLICATIONS

International Search Report—Oct. 19, 2011.

* cited by examiner

*Primary Examiner* — Terrell Matthews
(74) *Attorney, Agent, or Firm* — Edwards Wildman Palmer LLP; Christopher J. Cillié; Joshua L. Jones

(57) ABSTRACT

A screen panel with improved apertures for mining and quarrying industries adapted to be mounted on a screen deck, including a screening surface made up of materials such as herein described formed on a reinforcing frame, said screen panel having suitably designed apertures for allowing materials to pass through, said apertures having resilient ribs (5) with protrusions (4) on both sides configured with respect to each other such that adequate open space exists, whereby clogging of materials pursuant to screening operations are substantially reduced.

20 Claims, 4 Drawing Sheets

SCREEN PANEL WITH IMPROVED APERTURES

This application is a U.S. National Stage Application under 35 U.S.C. §371 based on International Application No. PCT/IN2011/000167, filed Mar. 11, 2011, which claims the benefit of priority to India Patent Application No. 981/KOL/2010, filed Sep. 1, 2010.

FIELD OF THE INVENTION

The present invention in general relates to screening arrangement for screening/separating or grading of minerals in the mining and quarrying industries and in particular to screen panels with improved apertures adapted to substantially reduce clogging of panels.

BACKGROUND OF THE INVENTION

Screening panel system for ore screening decks that is now widely used by the mining industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting or other means.

The screen panels known in the art, as described aforesaid, suffer from extensive clogging frequently due to the entrapment of near size particles onto the screen or by fines build up due to increased moisture content. Afterwards extra manpower needs to make the holes clear. To do this shut down of the operation is needed. Due to these factors screening efficiency goes down considerably. Research is on in this area for considerably long period of time to substantially reduce clogging of panels, pursuant to screening operations so that the screen panels are not rendered infective rather briskly. However, significant breakthrough in that perspective is yet to be achieved.

Accordingly there was a long felt need to design screen panels for its application in mining and quarrying industries, with improved apertures such that clogging of screen panels pursuant to screening operation are substantially reduced.

The present invention meets the aforesaid long felt need.

All through out the specification including the claims, the words "screen panel", "screen deck" "mining", "quarrying", "mineral", "ores", "walls", "button", "screening surface", "screening deck", are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide a screen panel with improved apertures, for its application in mining and quarrying industries, which is adapted to prevent/substantially reduce the clogging of screen panels, thereby increasing the life of the panel.

It is a further object of the present invention to provide a screen panel with improved apertures having a substantially higher longevity and adapted to create extra degree of freedom during screening operation.

It is a further object of the present invention to provide a screen panel having flexible aperture walls, thereby facilitating the mineral ores to pass through the apertures easily and also ensuring prevention of clogging.

It is another object of the present invention to provide a method for manufacturing a a screen panel with improved apertures, for its application in mining and quarrying industries, which is adapted to prevent/substantially reduce clogging of materials pursuant to screening operations.

It is a further object of the present invention to provide a screening deck for its application in the mining and quarrying industry, having mounted thereon a plurality of screen panels with improved protective apertures, for its application in mining and quarrying industries, which is adapted to prevent/substantially reduce the clogging of materials pursuant to screening operations thereby increasing the life of the panels.

How the foregoing objects are achieved and the other aspects of the present invention, will be clear from the following description which is purely by way of understanding and not by way of any sort of limitation.

SUMMARY OF THE INVENTION

Accordingly, the present invention provides a screen panel with improved apertures for mining and quarrying industries adapted to be mounted on a screen deck, including a screening surface made up of materials such as herein described formed on a reinforcing frame, said screen panel having suitably designed apertures for allowing materials to pass through, said apertures having resilient ribs with protrusions on both sides configured with respect to each other such that adequate open space exists, whereby clogging of materials pursuant to screening operations are substantially reduced.

In accordance with preferred embodiments of the screen panel of the present invention:

- said protrusions are configured about said ribs such that contact between said protrusions and said ribs are avoided,
- said ribs and protrusions are arranged in a manner such that openings are created through which materials can smoothly pass through,
- said protrusions are disposed on right and left side of said ribs,
- said ribs have adequate resilience to be deformed for ensuring passing of materials there through,
- said panel comprises of vulcanized material, rubber or polyurethane, having pin and lug type fixing or button type fixing,
- said ribs and said protrusions are made of polyurethane or rubber and the securing means is made of steel in case of button type or bolt down fixing or may be made of Polyurethane or any other material.

The present invention also provides a method of manufacturing a screen panel with improved apertures for mining and quarrying industries adapted to be mounted on a screen deck, including making suitably designed apertures for allowing materials to pass through, said method further including designing resilient ribs with protrusions on both sides, such that adequate open area is created, whereby clogging of materials pursuant to screening operation is substantially reduced.

In accordance with a preferred embodiment of the method of the present invention:

- said method comprises arranging said ribs and protrusions in a manner such that there is no contact with each other.

The present invention also provides a screening deck for mining and quarrying industries, having mounted thereon a plurality of screen panels with improved apertures, each said panel adapted to be mounted on a screen deck, including a screening surface made up of materials such as herein described formed on a reinforcing frame, said screen panel having suitably designed apertures for allowing materials of to pass through, said apertures having resilient ribs with proportions on both sides configured with respect to each other such that adequate open space exists, whereby clogging of materials pursuant to screening operations are substantially reduced.

BRIEF DESCRIPTION OF THE ACCOMPANYING DRAWINGS

The nature and scope of the present invention, will be better understood from the accompanying drawings, which are by way of illustration of some preferred embodiments and not by way of any sort of limitation. In the accompanying drawings, FIG. 1 illustrates a plan view of the screening surface having screen panels in accordance with a preferred embodiment of the present invention.

DETAILED DESCRIPTION OF THE INVENTION

The following describes some preferred embodiments of the present invention, which are purely for the sake of understanding the performance of the invention, and not by way of any sort of limitation.

The present invention is aimed at providing screen panels with improved apertures, for its application in mining and quarrying industries. This ensures preventing/substantially reducing clogging of the panels, thereby increasing the life of the panels. The screen panels in accordance with the present invention, nullifies/substantially reduces the drawbacks of the screen panels known in the art, as discussed hereinbefore under the heading "Background of the Invention". The present invention focuses on screening surface having screen panels which reduce clogging/blocking considerably while screening mineral ores.

The panels ensure smooth operation in the process. The improved apertures according to the invention have a special design for screening mineral ores, which helps in reducing the blocking or clogging in the deck by improving the independent motion of the members and its ligaments. Apart from this, the degree of freedom of movement in these types of apertures is better compared to the existing ones, due to which blinding problems are further reduced. These improved apertures facilitate reducing shutting down of operations, as much as possible.

Figure 1:
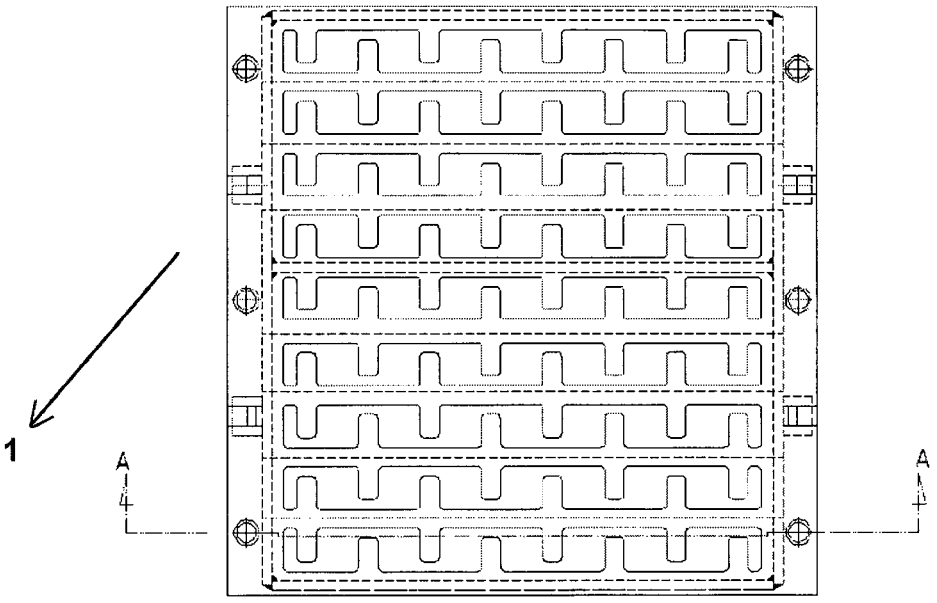

The screening surface (1) having screen panels with improved apertures according to the present invention is shown in the accompanying FIG. 1.

The screen panels are mounted on screen decks for causing screening/separating or grading of minerals in the mining and quarrying industries. Precisely, the present invention provides screen panels with improved apertures adapted for mounting on a screening deck, which includes a screening surface integrally formed on a reinforcing frame. Such screen panel has apertures having resilient ribs with protrusions on both sides. Those protrusions are arranged in a way to create enough open area. These protrusions are also arranged in a way to avoid contact with adjacent ribs, thus helping in creating extra degree of freedom. The ribs and protrusions thus create the opening in the panel through which material can easily pass through. This is cleanly shown in the accompanying FIG. 2, showing the improved apertures (2).

The screen panel is manufactured by hot vulcanizing or casting with rubber or polyurethane, having pin & lug type fixing or button type fixing. The screening surface comprises of ribs with protrusions on right and left side of the ribs. The protrusions are such that there is no contact between one protrusion and the adjacent rib, it means there is always a small gap left between the protrusion and the adjacent rib. The ribs have adequate resilience to be deformed during screening of ores thus ensures passing of ores through the opening.

The screen panels are secured to the frame by means of button type fixing or bolting or pin & lug type fixing.

Figure 2:
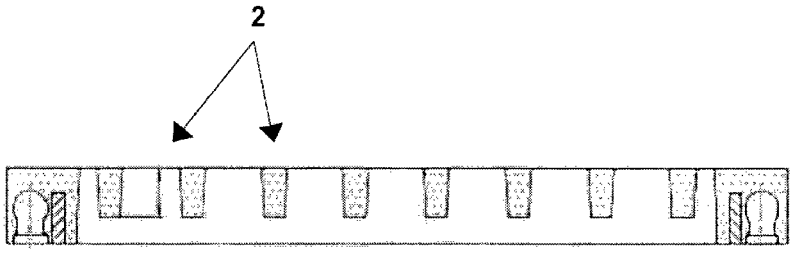
FIG. 2 illustrates a sectional view along the line A-A in FIG. 1.

The improved apertures according to the present invention are shown in the accompanying FIG. 2 very clearly, which is a sectional view along the line A-A in the accompanying FIG. 1.

Figure 3:
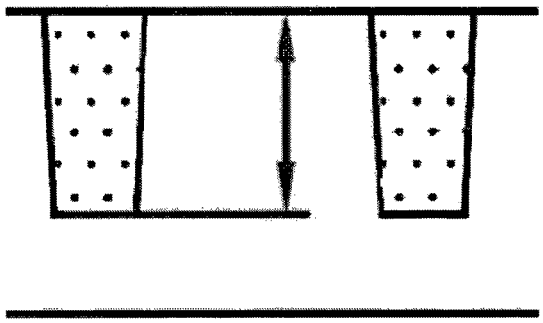
FIG. 3 illustrates an enlarged view of the improved apertures according to a preferred embodiment of the present invention.

The accompanying FIG. 3, shows an enlarged view of the improved apertures (2) according to the present invention.

The panels, the ribs, the protrusions in the ribs are made of polyurethane or rubber and the securing means is made of steel in case of button type or bolt down fixing or may be made of Polyurethane or any other material.

Figure 4:
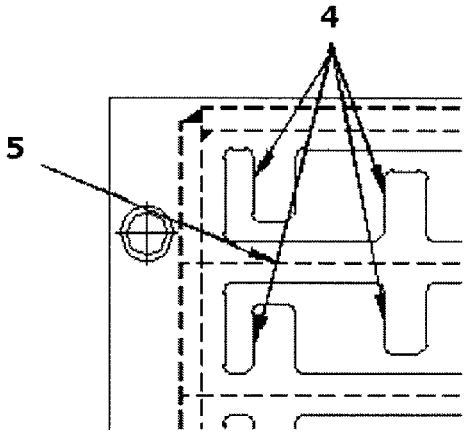
FIG. 4 illustrates the disposition of the ribs and protrusions according to a preferred embodiment of the present invention.

The accompanying FIG. 4 illustrates the disposition of the ribs (5) and protrusions (4). It is clearly shown in the accompanying FIG. 4 that the ribs (5) have protrusions (4) on both sides. The ribs are designed to be resilient and are being reinforced with polymeric cord. However, it should be understood, that the ribs may or may not be reinforced with polymeric or steel cord or any other type cord or flat.

Figure 5:
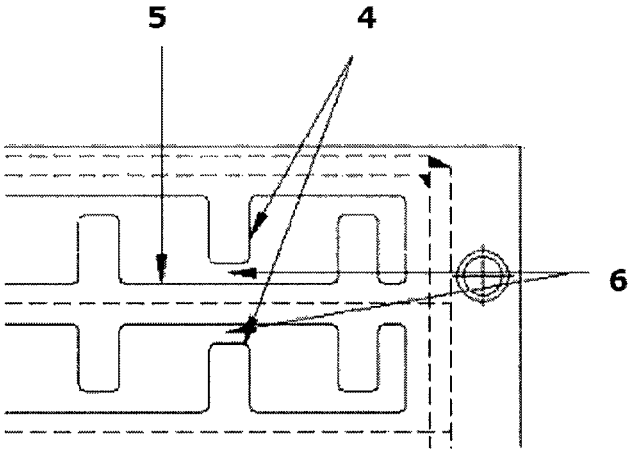
FIG. 5 illustrates an enlarged view of the features illustrated in the accompanying FIG. 4.
Figure 6:
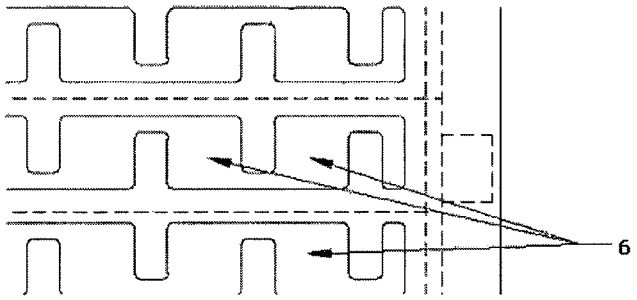
FIG. 6 illustrates a further enlarged view of the features illustrated in the accompanying FIG. 5.

The accompanying FIG. 5 further illustrates how the ribs (5) and protrusions (4) are configured, so that contact between such ribs and protrusions are avoided, so that adequate gap (6) exists. These gaps (6) are more clearly shown in the enlarged view in the accompanying FIG. 6 and hence materials can easily pass through these gaps.

When one particle gets stuck in the aperture, the flexibility of the ribs (5) and the small gaps (6) available between the ribs (5) and protrusions (4) allow the ribs to move slightly outwards and thus the stuck material is allowed to pass through the holes.

Since the protruded part is not continuous, it creates a differential movement thus making the stuck particle to either pass through or come out. This also creates the secondary vibration which throws the stuck material either outwards or inwards. In case of sticky materials as the protrusions (4) and the ribs (5) have a secondary vibration with differential movement it disallows the material to enter to the opening to some extent thereby increasing screening efficiency.

The present invention is applicable for all desired shapes of apertures, as required in the industry. The panels may be of different sizes, i.e.—modular type (305×305 mm and 610×300 mm) and larger sizes also. For modular type snap on type fixing, like button type, pin and sleeve type may be provided for mounting on to the screen deck.

The method of manufacturing screen panels according to the present invention comprises making suitably designed apertures for allowing materials to pass through. The method further includes designing resilient ribs with protrusions on both sides, such that adequate open area is created, whereby clogging of materials pursuant to screening operation is substantially reduced.

The present invention has been described with reference to some drawings and preferred embodiments, purely for the sake of understanding and not by way of any limitation and the present invention includes all legitimate developments within the scope of what has been described hereinbefore and claimed in the appended claims.

I claim:

1. A screen panel for mining and quarrying industries adapted to be mounted on a screen deck, including a screening surface formed on a reinforcing frame, said screen panel having a resilient rib with opposed first and second protrusions, wherein said resilient rib separates first and second apertures on opposite sides of said resilient rib, wherein said resilient rib and said first protrusion bound said first aperture, wherein said resilient rib and said second protrusion bound said second aperture, wherein said first and second protrusions extend symmetrically in opposite directions from said resilient rib and into said first and second apertures wherein said protrusions are configured with respect to each other such that adequate open space exists, such that clogging of said apertures is reduced and such that material can traverse said screen panel through said first and second apertures.

2. The screen panel as claimed in claim 1, wherein said first protrusion and said second protrusion are separated from one another along a length of said resilient rib such that contact between said first protrusion and said second protrusion is avoided.

3. The screen panel as claimed in claim 1, wherein said resilient rib, and said first protrusion, and said second protrusion are arranged such that materials can smoothly pass through said first and second aperture.

4. The screen panel as claimed in claim 1, wherein said resilient rib includes a third protrusion disposed on a side of said resilient rib laterally opposite said first protrusion, wherein said third protrusion is disposed longitudinally opposite said first protrusion.

5. The screen panel as claimed in claim 1, wherein said resilient rib is deformable for ensuring passing of materials there through.

6. The screen panel as claimed in claim 1, wherein said screen panel comprises vulcanized material, rubber or polyurethane, wherein said screen panel further includes a pin and lug type fixing or a button type fixing.

7. The screen panel as claimed in claim 6, wherein said resilient rib, first protrusion, and second protrusion include polyurethane or rubber, wherein said pin and type fixing or button type fixing includes steel.

8. A method of manufacturing a screen panel with improved apertures for mining and quarrying industries adapted to be mounted on a screen deck, the method comprising:

forming a resilient rib with opposed first and second protrusions;

defining first and second apertures on opposite sides of said resilient rib such that said resilient rib separates said first aperture from said second aperture;

wherein said resilient rib and said first protrusion bound said first aperture;

wherein said resilient rib and said second protrusion bound said second aperture; and wherein said first and second protrusions extend symmetrically in opposite directions from said resilient rib and into said first and second apertures for allowing materials to pass through, wherein said protrusions are configured with respect to each other such that adequate open space exists, such that clogging of said apertures is reduced and such that material can traverse said first and second apertures.

9. The method as claimed in claim 8, wherein said rib is a first rib and the method further including forming a second rib with a protrusion on a side of the first aperture such that gaps are defined between (a) said first protrusion and said second resilient rib, (b) said second protrusion and said second resilient rib, and (c) said third protrusion and said first resilient rib.

10. A screening deck for mining and quarrying industries, having mounted thereon a plurality of screen panels with apertures, each said screen panel adapted to be mounted on said screening deck, said screen panel including a screening surface made up of materials formed on a reinforcing frame, and having:

a resilient rib with opposed first and second protrusions;

wherein said resilient rib separates first and second apertures on opposite sides of said resilient rib;

wherein said resilient rib and said first protrusion bound said first aperture;

wherein said resilient rib and said second protrusion bound said second aperture; and wherein said first and second protrusions extend symmetrically in opposite directions from said resilient rib and into said first and second apertures wherein said protrusions are configured with respect to each other such that adequate open space exists, such that clogging of said apertures is reduced and such that material can traverse said screen panel through said first and second apertures.

11. The screen panel as recited in claim 10, wherein said first protrusion and said second protrusion extend into said first aperture by an equivalent distance.

12. The screen panel as recited in claim 1, wherein said resilient rib is a first resilient rib, where said screen panel further includes a second resilient rib with a third protrusion on a side of said first aperture opposite said first resilient rib.

13. The screen panel as recited in claim 12, wherein said third protrusion is disposed along a length of said second resilient rib such that said third protrusion extends toward said first resilient rib between said first and second protrusions.

14. The screen panel as recited in claim 12, wherein said second resilient rib defines an edge of said screen panel.

15. The screen panel as recited in claim 12, wherein said first protrusion and said third protrusion extend into said first aperture by about the same distance.

16. The screen panel as recited in claim 12, wherein said second resilient rib defines a fourth protrusion, wherein said third and fourth protrusions extend symmetrically in opposite directions from said second resilient rib.

17. The screen panel as recited in claim 16, wherein said fourth protrusion is adjacent to adjacent edges of said screen panel.

18. The screen panel as recited in claim 1, wherein said resilient rib includes polymeric reinforcing cord.

19. The screen panel as recited in claim 1, wherein said resilient rib includes steel reinforcement cord.

20. The screen panel as recited in claim 1, wherein said resilient rib includes steel flat reinforcements.

* * * * *